US008989619B2

(12) United States Patent
Karasawa et al.

(10) Patent No.: US 8,989,619 B2
(45) Date of Patent: Mar. 24, 2015

(54) IMAGE FORMING APPARATUS HAVING TRANSFER BELT CONTACT AND SEPARATING MECHANISM INTERFERING WITH REMOVABLE UNIT

(71) Applicants: Shinya Karasawa, Kanagawa (JP); Ken Amemiya, Tokyo (JP); Michiya Okamoto, Kanagawa (JP); Takuma Iwasaki, Kanagawa (JP); Hiroyuki Uenishi, Kanagawa (JP)

(72) Inventors: Shinya Karasawa, Kanagawa (JP); Ken Amemiya, Tokyo (JP); Michiya Okamoto, Kanagawa (JP); Takuma Iwasaki, Kanagawa (JP); Hiroyuki Uenishi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 101 days.

(21) Appl. No.: 13/761,309

(22) Filed: Feb. 7, 2013

(65) Prior Publication Data

US 2013/0243444 A1 Sep. 19, 2013

(30) Foreign Application Priority Data

Mar. 17, 2012 (JP) ..... 2012-061300

(51) Int. Cl.

| | |
|---|---|
| ***G03G 15/16*** | (2006.01) |
| ***G03G 15/00*** | (2006.01) |
| ***G03G 15/01*** | (2006.01) |
| ***G03G 21/12*** | (2006.01) |

(Continued)

(52) U.S. Cl.

CPC ..... *G03G 21/1671* (2013.01); *G03G 15/0136* (2013.01); *G03G 21/12* (2013.01); *G03G 21/1647* (2013.01); *G03G 21/168* (2013.01); *G03G 21/169* (2013.01); *G03G 21/1842* (2013.01)

USPC ..... 399/101; 399/110

(58) Field of Classification Search

CPC . G03G 15/0136; G03G 21/12; G03G 21/168; G03G 21/169; G03G 2215/0193; G03G 2215/1618; G03G 2215/1642

USPC ..... 399/13, 101, 110, 121, 123, 358, 360

See application file for complete search history.

(56) References Cited

U.S. PATENT DOCUMENTS

| | | | | |
|---|---|---|---|---|
| 6,937,838 | B2 * | 8/2005 | Ishii et al. | 399/358 |
| 7,382,999 | B2 * | 6/2008 | Takahashi | 399/110 |

(Continued)

FOREIGN PATENT DOCUMENTS

| | | |
|---|---|---|
| JP | 2-166470 | 6/1990 |
| JP | 6-348148 | 12/1994 |

(Continued)

*Primary Examiner* — Robert Beatty

(74) *Attorney, Agent, or Firm* — Harness, Dickey & Pierce, P.L.C.

(57) ABSTRACT

An image forming apparatus includes an image carrier removably installed in the apparatus to carry an image; a transfer member contacting with the image carrier to transfer the image onto the transfer member or a recording medium; a contact and separation mechanism causing the transfer member to contact with or separate from the image carrier; and a removable unit removably installed in the apparatus from the same direction as an installation direction of the image carrier to be disposed proximal of the image carrier and the transfer member in the installation direction, and at least partially overlapping the image carrier and the transfer member as viewed in the installation direction. The removable unit interferes with the contact and separation mechanism and is prevented from being installed in the apparatus, when the transfer member is separated from the image carrier by the contact and separation mechanism.

13 Claims, 5 Drawing Sheets

(51) Int. Cl.
*G03G 21/16* (2006.01)
*G03G 21/18* (2006.01)

(56) References Cited

U.S. PATENT DOCUMENTS

| | | | | |
|---|---|---|---|---|
| 8,238,790 | B2 * | 8/2012 | Furuya et al. | 399/121 |
| 8,639,132 | B2 * | 1/2014 | Sato et al. | 399/35 |
| 8,725,009 | B2 * | 5/2014 | Tomita et al. | 399/13 |
| 2010/0034557 | A1 | 2/2010 | Arai et al. | |
| 2012/0014728 | A1 | 1/2012 | Karasawa et al. | |
| 2012/0107012 | A1 | 5/2012 | Amemiya et al. | |
| 2012/0195661 | A1 | 8/2012 | Karasawa et al. | |
| 2012/0237230 | A1 | 9/2012 | Karasawa et al. | |
| 2013/0064572 | A1 * | 3/2013 | Shiba et al. | 399/121 |

FOREIGN PATENT DOCUMENTS

| | | | |
|---|---|---|---|
| JP | 08248862 | A * | 9/1996 |
| JP | 2006308799 | A * | 11/2006 |
| JP | 2007101794 | A * | 4/2007 |

* cited by examiner

IMAGE FORMING APPARATUS HAVING TRANSFER BELT CONTACT AND SEPARATING MECHANISM INTERFERING WITH REMOVABLE UNIT

CROSS-REFERENCE TO RELATED APPLICATION

This patent application is based on and claims priority pursuant to 35 U.S.C. §119 to Japanese Patent Application No. 2012-061300, filed on Mar. 17, 2012, in the Japan Patent Office, the entire disclosure of which is hereby incorporated by reference herein.

BACKGROUND OF THE INVENTION

1. Field of the Invention

The present invention relates to an image forming apparatus, such as a copier, a printer, a facsimile machine, or a multifunction machine combining several of the functions of these apparatuses, particularly to an image forming apparatus including an image carrier removably installed therein.

2. Description of the Related Art

In an image forming apparatus such as a copier or a printer, in some cases an image carrier such as a photoconductor drum is removably (i.e., replaceably) installed in the body of the image forming apparatus. The image carrier such as a photoconductor drum may be a component of a process cartridge such that, when the process cartridge in the body of the image forming apparatus is replaced with a new process cartridge, the image carrier is also replaced with a new image carrier.

Further, the image forming apparatus may be configured such that a transfer member of a transfer device is contactable with and separable from the image carrier, and that the transfer member is brought into contact with the image carrier in a normal image forming operation and is separated from the image carrier in, for example, replacement of the image carrier. In this type of image forming apparatus, the image carrier is replaced when the transfer member is separated therefrom. This configuration therefore reduces the possibility of the image carrier and the transfer member interfering with each other and damaging respective surfaces thereof in replacement work.

According to this configuration, however, an operator may mistakenly operate the image forming apparatus with the transfer member separated from the image carrier after the completion of the replacement work of the image carrier. In such a case, the image forming apparatus may fail to form a normal image, or may fail to normally feed a recording medium.

SUMMARY OF THE INVENTION

The present invention describes a novel image forming apparatus that, in one example, includes an image carrier, a transfer member, a contact and separation mechanism, and a removable unit. The image carrier is configured to be removably installed in the image forming apparatus to carry a toner image. The transfer member is configured to come into contact with the image carrier to transfer the toner image from the image carrier onto a surface of one of the transfer member and a recording medium fed to a position between the transfer member and the image carrier. The contact and separation mechanism is configured to move the transfer member relative to the image carrier to bring the transfer member into contact with the image carrier, and is configured to move the transfer member relative to the image carrier to separate the transfer member from the image carrier. The removable unit is configured to be removably installed in the image forming apparatus from the same direction as an installation direction of the image carrier to be disposed proximal of the image carrier and the transfer member in the installation direction, and is configured to at least partially overlap the image carrier and the transfer member as viewed in the installation direction. The removable unit interferes with the contact and separation mechanism and is prevented from being installed in the image forming apparatus in a state in which the transfer member is separated from the image carrier by the contact and separation mechanism.

The contact and separation mechanism may include a lever configured to be rotated to bring the transfer member into contact with the image carrier, and configured to be rotated to separate the transfer member from the image carrier. When the transfer member is separated from the image carrier, the lever may be rotated to a position at which the lever interferes with the removable unit. When the transfer member is in contact with the image carrier, the lever may be rotated to a position at which the lever does not interfere with the removable unit.

The image forming apparatus may further include a detector configured to detect a state in which the removable unit is installed in the image forming apparatus. The image forming apparatus may be prevented from operating when the detector detects that removable unit is not installed in the image forming apparatus.

The image forming apparatus may further include a cleaning device configured to remove untransferred toner remaining on the image carrier as waste toner and a transport tube configured to transport the waste toner discharged by the cleaning device. The removable unit may include a waste toner collecting container configured to store the waste toner. The waste toner collecting container may be brought into contact with the transport tube when installed in the image forming apparatus, and may be separated from the transport tube when removed from the image forming apparatus.

The image forming apparatus may further include a drive gear configured to transmit drive force. The transport tube may include an outlet configured to discharge the waste toner and a shutter member configured to open and close the outlet. The waste toner collecting container may include a pressing member configured to press the shutter member of the transport tube and open the outlet in accordance with the installation of the waste toner collecting container into the image forming apparatus, a transport member configured to transport the waste toner stored in the waste toner collecting container, and a gear configured to mesh with the drive gear in accordance with the installation of the waste toner collecting container into the image forming apparatus to transmit the drive force to the transport member.

The present invention further describes another novel image forming apparatus that, in one example, includes an image carrier, a transfer member, a contact and separation mechanism, and a removable unit. The image carrier is configured to be removably installed in the image forming apparatus to carry a toner image. The transfer member is configured to come into contact with the image carrier to transfer the toner image from the image carrier onto a surface of one of the transfer member and a recording medium fed to a position between the transfer member and the image carrier. The contact and separation mechanism is configured to move the transfer member relative to the image carrier to bring the transfer member into contact with the image carrier, and is configured to move the transfer member relative to the image carrier to separate the transfer member from the image carrier.

The removable unit is configured to be removably installed in the image forming apparatus from the same direction as an installation direction of the image carrier to be disposed proximal of the image carrier and the transfer member in the installation direction, and is configured to at least partially overlap the image carrier and the transfer member as viewed in the installation direction. The contact and separation mechanism brings the transfer member into contact with the image carrier in accordance with installation of the removable unit into the image forming apparatus, and separates the transfer member from the image carrier in accordance with removal of the removable unit from the image forming apparatus.

The image forming apparatus may further include a detector configured to detect a state in which the removable unit is installed in the image forming apparatus. The image forming apparatus may be prevented from operating when the detector detects that the removable unit is not installed in the image forming apparatus.

The image forming apparatus may further include a cleaning device configured to remove untransferred toner remaining on the image carrier as waste toner and a transport tube configured to transport the waste toner discharged by the cleaning device. The removable unit may include a waste toner collecting container configured to store the waste toner. The waste toner collecting container may be brought into contact with the transport tube when installed in the image forming apparatus, and may be separated from the transport tube when removed from the image forming apparatus.

The image forming apparatus may further include a drive gear configured to transmit drive force. The transport tube may include an outlet configured to discharge the waste toner and a shutter member configured to open and close the outlet. The waste toner collecting container may include a pressing member configured to press the shutter member of the transport tube and open the outlet in accordance with the installation of the waste toner collecting container into the image forming apparatus, a transport member configured to transport the waste toner stored in the waste toner collecting container, and a gear configured to mesh with the drive gear in accordance with the installation of the waste toner collecting container into the image forming apparatus to transmit the drive force to the transport member.

BRIEF DESCRIPTION OF THE SEVERAL VIEWS OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
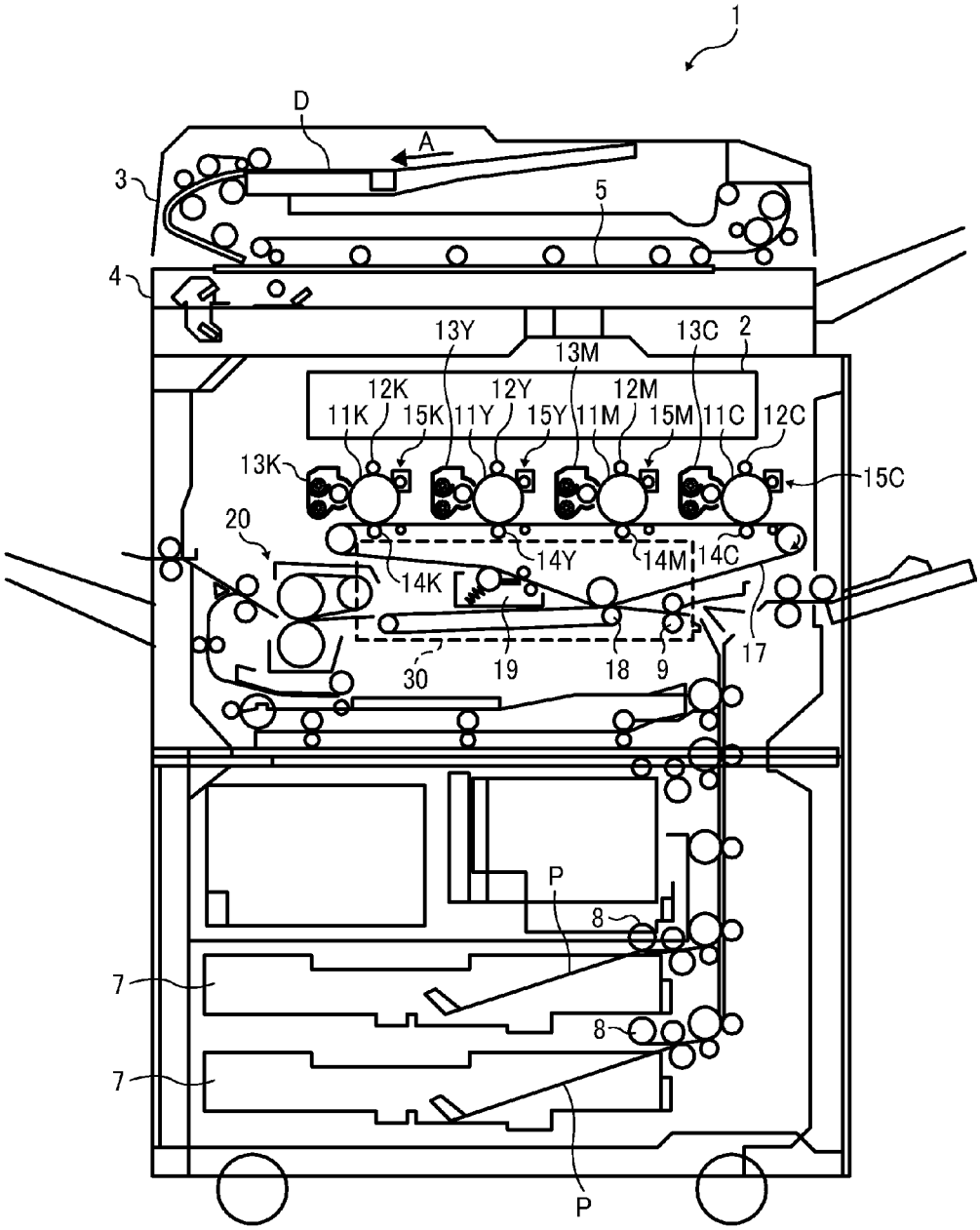
FIG. 1 is a diagram illustrating an overall configuration of an image forming apparatus according to an embodiment of the present invention.

In describing the embodiments illustrated in the drawings, specific terminology is adopted for the purpose of clarity. However, the disclosure of the present invention is not intended to be limited to the specific terminology so used, and it is to be understood that substitutions for each specific element can include any technical equivalents that have the same function, operate in a similar manner, and achieve a similar result.

Referring now to the drawings, wherein like reference numerals designate identical or corresponding parts throughout the several views, embodiments of the present invention will be described in detail. In the following, redundant description of parts once described will be simplified or omitted.

With reference to FIG. 1, description will first be given of the overall configuration and operation of an image forming apparatus according to an embodiment of the present invention. An image forming apparatus illustrated in FIG. 1 is a tandem-type color copier having an apparatus body 1 including a document feeder 3, a document reader 4 including a contact glass 5, a writing unit 2, sheet feeding units 7 each including a sheet feed roller 8, a registration roller pair 9, process cartridges 15K, 15Y, 15M, and 15C respectively including photoconductor drums 11K, 11Y, 11M, and 11C and charging rollers 12K, 12Y, 12M, and 12C, development devices 13K, 13Y, 13M, and 13C, primary transfer bias rollers 14K, 14Y, 14M, and 14C, an intermediate transfer belt 17, a secondary transfer bias roller 18, an intermediate transfer belt cleaning device 19, a fixing device 20, and a waste toner collecting container 30.

The document feeder 3 feeds a document D to the document reader 4. The document reader 4 reads image information of the document D. The writing unit 2 emits beams of laser light based on the input image information. Each of the sheet feeding units 7 stores a recording medium P, such as a transfer sheet. The registration roller pair 9 serves as a timing roller pair which adjusts the timing of feeding the recording medium P. The photoconductor drums 11K, 11Y, 11M, and 11C serve as image carriers on which toner images of black, yellow, magenta, and cyan colors are formed. The charging rollers 12K, 12Y, 12M, and 12C serve as charging devices which charge respective outer circumferential surfaces of the photoconductor drums 11K, 11Y, 11M, and 11C. The development devices 13K, 13Y, 13M, and 13C develop electrostatic latent images formed on the photoconductor drums 11K, 11Y, 11M, and 11C, to thereby form toner images. The primary transfer bias rollers 14K, 14Y, 14M, and 14C superimpose and transfer the toner images formed on the photoconductor drums 11K, 11Y, 11M, and 11C onto the recording medium P. The intermediate transfer belt 17 serves as a transfer member having an outer circumferential surface onto which the toner images of the plurality of colors are superimposed and transferred. The secondary transfer bias roller 18 transfers the color toner images on the intermediate transfer belt 17 onto the recording medium P. The intermediate transfer belt cleaning device 19 cleans the intermediate transfer belt 17. The fixing device 20 fixes the unfixed images on the recording medium P. The waste toner collecting container 30 stores collected waste toner.

Description will now be given of a normal color image forming operation performed by the image forming apparatus. Image forming processes performed on the photoconductor drums 11K, 11Y, 11M, and 11C may be referred to FIG. 2, in which the photoconductor drums 11K, 11Y, 11M, and 11C are designated as a photoconductor drum 11.

The document D on a document table of the document feeder 3 is first fed in the direction of arrow A in FIG. 1 by feed rollers of the document feeder 3, and is placed onto the contact glass 5 of the document reader 4. Then, the image information of the document D placed on the contact glass 5 is optically read by the document reader 4.

Specifically, the document reader 4 scans the image of the document D on the contact glass 5, while irradiating the document D with light emitted from an illuminating lamp thereof. The light reflected by the document D is imaged by a color sensor through mirrors and lenses. Color image information of the document D is read by the color sensor for each of color-separated light beams of RGB (i.e., red, green, and blue), and thereafter is converted into electrical image signals. Further, on the basis of the color-separated image signals of RGB, an image processor performs processing, such as color conversion, color correction, and spatial frequency correction, to obtain color image information of the black, yellow, magenta, and cyan colors.

Figure 2:
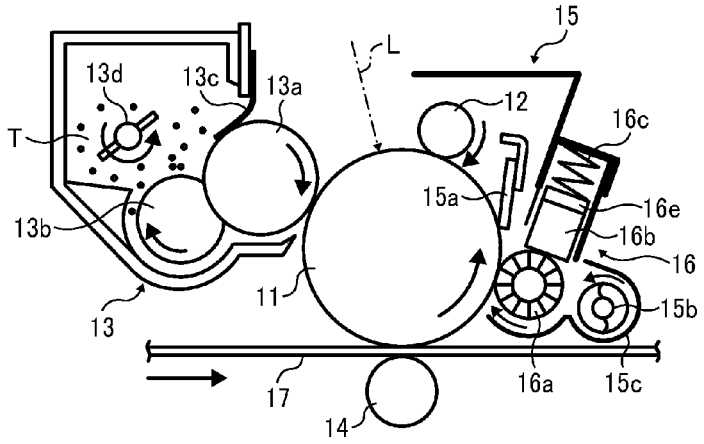
FIG. 2 is a diagram illustrating an image forming unit included in the image forming apparatus.

The image information of the black, yellow, magenta, and cyan colors is transmitted to the writing unit 2. Then, as illustrated in FIG. 2, beams of laser light L based on the image information of the respective colors are emitted from the writing unit 2 to the respective photoconductor drums 11K, 11Y, 11M, and 11C.

Meanwhile, the four photoconductor drums 11K, 11Y, 11M, and 11C rotate counterclockwise in FIG. 1. The outer circumferential surface of each of the photoconductor drums 11K, 11Y, 11M, and 11C is first uniformly charged at a position facing the corresponding one of the charging roller 12K, 12Y, 12M, and 12C serving as a charging device. That is, a charging process is performed. Thereby, a charging potential is formed on each of the photoconductor drums 11K, 11Y, 11M, and 11C. Thereafter, the charged outer circumferential surface of each of the photoconductor drums 11K, 11Y, 11M, and 11C reaches a laser light irradiation position.

Beams of laser light corresponding to the image signals of the respective colors are emitted from four not-illustrated light sources of the writing unit 2, and pass different light paths corresponding to the respective color components of black, yellow, magenta, and cyan. That is, an exposure process is performed.

The beam of laser light corresponding to the black component is directed to the outer circumferential surface of the leftmost photoconductor drum 11K in FIG. 1. In this process, the beam of laser light corresponding to the black component is deflected by a not-illustrated high-speed rotating polygon mirror to scan the photoconductor drum 11K along the rotation axis thereof, i.e., in a main scanning direction. Thereby, an electrostatic latent image corresponding to the black component is formed on the photoconductor drum 11K charged by the charging roller 12K.

Similarly, the beam of laser light corresponding to the yellow component is directed to the outer circumferential surface of the second leftmost photoconductor drum 11Y in FIG. 1, to thereby form an electrostatic latent image corresponding to the yellow component. Further, the beam of laser light corresponding to the magenta component is directed to the outer circumferential surface of the third leftmost photoconductor drum 11M in FIG. 1, to thereby form an electrostatic latent image corresponding to the magenta component. Further, the beam of laser light corresponding to the cyan component is directed to the outer circumferential surface of the fourth leftmost photoconductor drum 11C in FIG. 1, to thereby form an electrostatic latent image corresponding to the cyan component.

Thereafter, the outer circumferential surfaces of the photoconductor drums 11K, 11Y, 11M, and 11C formed with the electrostatic latent images of the respective colors reach respective positions facing the development devices 13K, 13Y, 13M, and 13C. Then, toners of the respective colors are supplied onto the photoconductor drums 11K, 11Y, 11M, and 11C by the development devices 13K, 13Y, 13M, and 13C, to thereby develop the latent images on the photoconductor drums 11K, 11Y, 11M, and 11C. That is, a development process is performed.

After the development process, the outer circumferential surfaces of the photoconductor drums 11K, 11Y, 11M, and 11C reach respective positions facing the intermediate transfer belt 17 serving as a transfer member. At the positions, the primary transfer bias rollers 14K, 14Y, 14M, and 14C are disposed to be in contact with the inner circumferential surface of the intermediate transfer belt 17. At the positions of the primary transfer bias rollers 14K, 14Y, 14M, and 14C, the toner images of the respective colors formed on the photoconductor drums 11K, 11Y, 11M, and 11C are sequentially superimposed and transferred onto the intermediate transfer belt 17. That is, a primary transfer process is performed.

After the primary transfer process, the outer circumferential surface of each of the photoconductor drums 11K, 11Y, 11M, and 11C reaches a position facing a cleaning blade 15*a* illustrated in FIG. 2, which is a cleaning device included in the corresponding one of the process cartridges 15K, 15Y, 15M, and 15C. Then, untransferred toner remaining on the outer circumferential surface is collected by the cleaning blade 15*a*. That is, a cleaning process is performed.

Thereafter, the outer circumferential surface of each of the photoconductor drums 11K, 11Y, 11M, and 11C reaches and is discharged by a not-illustrated discharging device. Thereby, a series of image forming processes on the photoconductor drums 11K, 11Y, 11M, and 11C is completed.

Meanwhile, the intermediate transfer belt 17 having (i.e., carrying) the toner images of the respective colors superimposed and transferred thereto from the photoconductor drums 11K, 11Y, 11M, and 11C rotates clockwise in FIG. 1, and reaches a position facing the secondary transfer bias roller 18. At the position facing the secondary transfer bias roller 18, the color toner images carried on the intermediate transfer belt 17 are transferred onto the recording medium P. That is, a secondary transfer process is performed.

Thereafter, the intermediate transfer belt 17 reaches a position facing the intermediate transfer belt cleaning device 19, and untransferred toner adhering to the outer circumferential surface of the intermediate transfer belt 17 is collected by the intermediate transfer belt cleaning device 19. Thereby, a series of transfer processes on the intermediate transfer belt 17 is completed.

Meanwhile, the recording medium P is fed to a secondary transfer nip formed between the intermediate transfer belt 17 and the secondary transfer bias roller 18 from one of the sheet feeding units 7 via rollers such as the registration roller pair 9. Specifically, from one of the sheet feeding units 7 storing the recording medium P, the recording medium P is fed by the corresponding sheet feed roller 8, and is guided toward the registration roller pair 9 by not-illustrated feeding guide members. The recording medium P then reaches the registration roller pair 9, and is fed toward the secondary transfer nip with appropriate timing.

Then, a full-color image is transferred onto the recording medium P, and the recording medium P is guided to the fixing device 20 by a feed belt. In the fixing device 20, the full-color image is fixed on the recording medium P at a nip formed between a fixing belt and a pressure roller included in the fixing device 20. After the fixing process, the recording medium P with the image is discharged (i.e., output) outside the apparatus body 1 by a sheet discharge roller pair, thereby completing a series of processes of the image forming operation.

Figure 3:
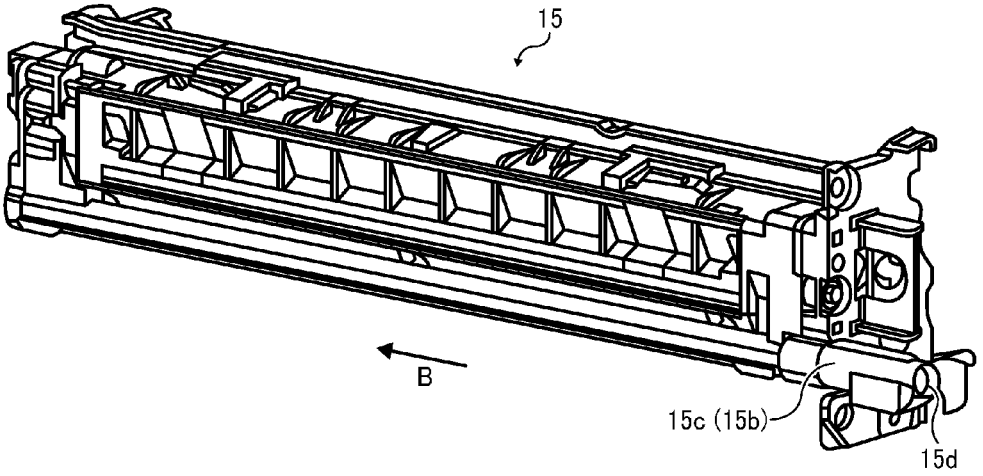
FIG. 3 is a schematic perspective view illustrating a process cartridge included in the image forming unit.

With reference to FIGS. 2 and 3, an image forming unit included in the image forming apparatus will now be described in detail. The image forming apparatus of the present embodiment includes four image forming units for the respective colors, which are substantially similar in structure. FIGS. 2 and 3, therefore, illustrate components of one of the image forming units without the alphabetical suffixes K, Y, M, and C.

As illustrated in FIG. 2, the image forming unit includes the photoconductor drum 11, the charging roller 12, the development device 13, the cleaning blade 15*a*, a transport screw 15*b*, a transport tube 15*c*, and a lubricant supply device 16. The photoconductor drum 11 serves as an image carrier. The charging roller 12 serves as a charging device which charges the photoconductor drum 11. The development device 13 develops an electrostatic latent image formed on the photoconductor drum 11, and includes a development roller 13*a*, a supply roller 13*b*, a doctor blade 13*c*, and a mixing member 13*d*. The cleaning blade 15*a* serves as a cleaning device which collects untransferred toner remaining on the photoconductor drum 11. The lubricant supply device 16 supplies a lubricant onto the photoconductor drum 11, and includes a lubricant supply roller 16*a*, a solid lubricant 16*b*, a holder 16*e*, and a compression spring 16*c*.

In the present embodiment, the photoconductor drum 11, the charging roller 12, the cleaning blade 15*a*, and the lubricant supply device 16 included in the components of the image forming unit are integrated as the process cartridge 15 configured as a removable unit installable in and removable from the apparatus body 1. Further, the development device 13 is configured as a unit separated from the process cartridge 15 and independently installable in and removable from the apparatus body 1.

Similarly to the image forming units for the respective colors, the process cartridges 15K, 15Y, 15M, and 15C for the respective colors are also substantially similar in structure. Each of the process cartridges 15K, 15Y, 15M, and 15C has an exterior as illustrated in FIG. 3. In FIG. 3, a reference numeral 15*d* denotes a later-described shutter member, and arrow B indicates the direction of installing the process cartridge 15 in the apparatus body 1 (hereinafter referred to as the installation direction).

In the present embodiment, the photoconductor drum 11 serving as an image carrier is a negatively charged organic photoconductor including a drum-shaped conductive support member and a plurality of layers, such as photosensitive layers, provided around an outer circumferential surface of the support member. Although illustration is omitted, the photoconductor drum 11 includes an insulating under layer, a photosensitive charge generating layer, a photosensitive charge transporting layer, and a protective surface layer sequentially laminated around the outer circumferential surface of the conductive support member serving as a base layer. The conductive support member of the photoconductor drum 11 serving as a base layer may be made of a conductive material having volume resistivity of approximately $10^{10}$ Ωcm or less.

The charging roller 12 serving as a charging device is a roller including a conductive core bar forming a shaft portion and a medium-resistance elastic layer covering an outer circumferential surface of the core bar. The charging roller 12 is disposed to be in contact with the photoconductor drum 11 at a position downstream of the lubricant supply device 16 in the rotation direction of the photoconductor drum 11. Further, the charging roller 12 is supplied with a predetermined charging bias voltage by a not-illustrated power supply unit provided to the apparatus body 1, to thereby uniformly charge the outer circumferential surface of the photoconductor drum 11 facing the charging roller 12. In the present embodiment, the charging roller 12 is kept in contact with the photoconductor drum 11. Alternatively, the charging roller 12 may be configured to face the photoconductor drum 11 such that the charging roller 12 is separated from the photoconductor drum 11 with a slight gap formed therebetween.

In the development device 13, the development roller 13*a* is disposed to be in contact with the photoconductor drum 11 to form a development area (i.e., development nip) therebetween. The development device 13 contains toner T serving as a one-component developer, and develops the electrostatic latent image formed on the photoconductor drum 11, to thereby form a toner image. Specifically, as illustrated in FIG. 2, the development device 13 of the present embodiment employs a one-component development system, and includes the development roller 13*a* serving as a developer carrier, the supply roller 13*b*, the doctor blade 13*c* serving as a layer thinning member, and the mixing member 13*d*.

The thus-configured development device 13 operates as follows. A part of the toner T supplied to and contained in the development device 13 is first carried by the supply roller 13*b*, and then is frictionally charged at a portion of the supply roller 13*b* pressed against the development roller 13*a*. Thereafter, the toner T moves onto and is carried by the development roller 13*a*, and is uniformly spread into a relatively thin layer at a position facing the doctor blade 13*c*. The toner T then reaches the development area corresponding to the position at which the development roller 13*a* is in contact with the photoconductor drum 11. At this position, the toner T is attracted to the latent image on the photoconductor drum 11 by a development electric field generated in the development area. In the present embodiment, the development roller 13*a* is kept in contact with the photoconductor drum 11. Alternatively, the development roller 13*a* may be configured to face the photoconductor drum 11 such that the development roller 13*a* is separated from the photoconductor drum 11 with a slight gap formed therebetween.

Figure 7:
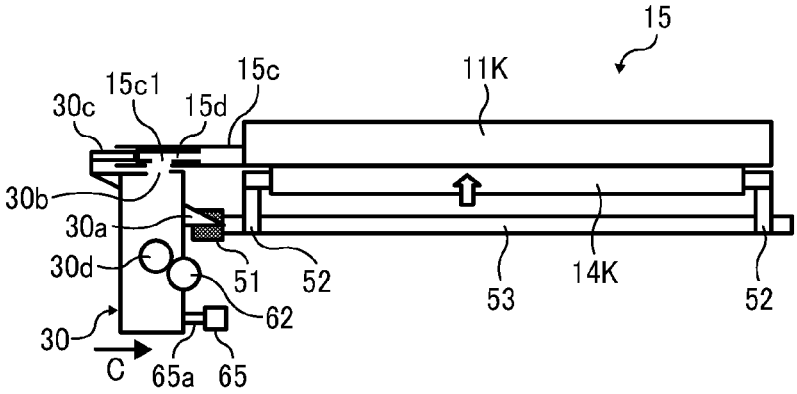
FIG. 7 is a schematic diagram illustrating a state in which the waste toner collecting container is installed in the body of the image forming apparatus.

The cleaning blade 15*a* disposed downstream of the lubricant supply device 16 in the rotation direction of the photoconductor drum 11 is made of a rubber material, such as urethane rubber, and is kept in contact with the outer circumferential surface of the photoconductor drum 11 with predetermined pressure at a predetermined angle. Thereby, deposits such as untransferred toner adhering to the photoconductor drum 11 are mechanically scraped off and collected into the process cartridge 15. The toner collected in the process cartridge 15 is transported, as waste toner, toward the waste toner collecting container 30 illustrated in FIG. 7 by the transport screw 15*b*. As illustrated in FIG. 7, the transport tube 15*c* of the process cartridge 15 including therein the transport screw 15*b* is connected to the waste toner collecting container 30 installed in the apparatus body 1.

The deposits adhering to the photoconductor drum 11 include, in addition to the untransferred toner, paper dust arising from the recording medium P, such as a sheet, discharge products produced on the photoconductor drum 11 in discharge of the charging roller 12, and an additive added to the toner, for example. Further, the cleaning blade 15*a* of the present embodiment also functions as a layer thinning blade with which the lubricant supplied to the photoconductor drum 11 by the lubricant supply roller 16*a* is spread in a relatively thin layer.

In the lubricant supply device 16, the lubricant supply roller 16*a* is a brush roller which slides over the photoconductor drum 11 and the solid lubricant 16*b*. Further, the holder 16*e* holds the solid lubricant 16*b*, and the compression spring 16*c* serves as a biasing device which biases the solid lubricant 16*b* and the holder 16*e* toward the lubricant supply roller 16*a*. The thus-configured lubricant supply device 16 supplies the lubricant to the photoconductor drum 11, and the lubricant supplied to the photoconductor drum 11 is spread into a relatively thin layer by the cleaning blade 15*a* disposed downstream of the lubricant supply device 16 in the rotation direction of the photoconductor drum 11.

Figure 4:
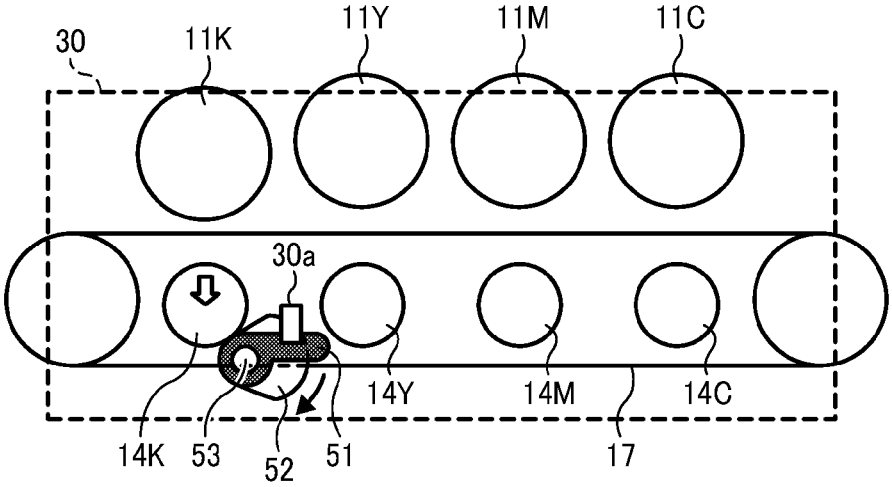
FIG. 4 is a schematic diagram illustrating a state in which an intermediate transfer belt is separated from photoconductor drums in the image forming units.
Figure 5:
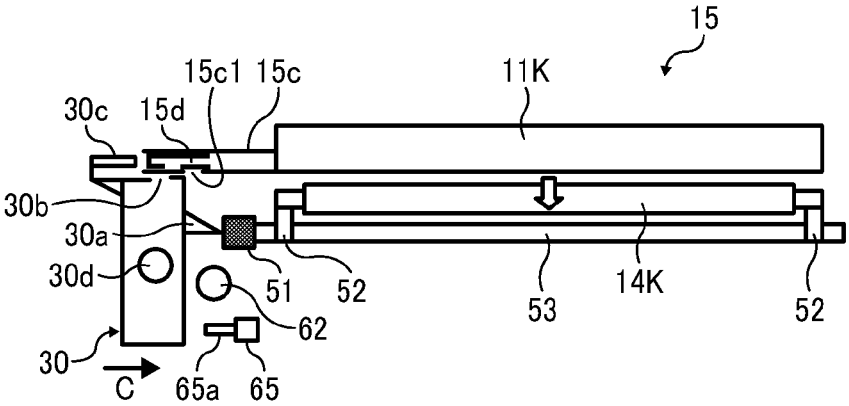
FIG. 5 is a schematic diagram illustrating a state in which a waste toner collecting container interferes with an intermediate transfer belt contact and separation mechanism.
Figure 6:
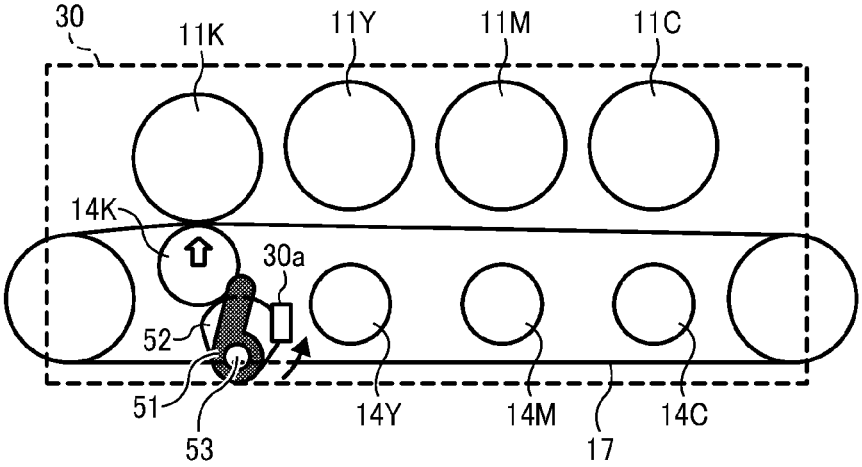
FIG. 6 is a schematic diagram illustrating a state in which the intermediate transfer belt is in contact with a photoconductor drum.
Figure 8:
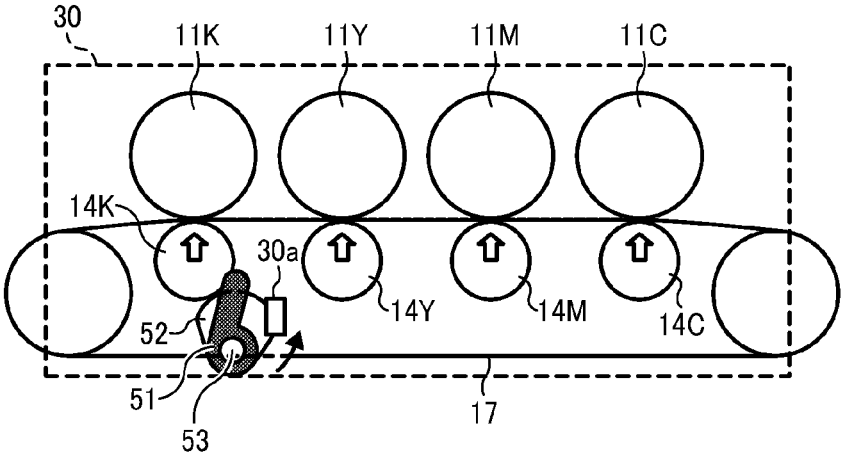
FIG. 8 is a schematic diagram illustrating a state in which the intermediate transfer belt is in contact with four photoconductor drums.

With reference to FIGS. 4 to 8, the configuration and operation of the image forming apparatus of the present embodiment will be described in detail. FIG. 4 is a schematic diagram illustrating a state in which the intermediate transfer belt 17 is separated from the four photoconductor drums 11K, 11Y, 11M, and 11C. FIG. 5 is a schematic diagram illustrating a state in which the intermediate transfer belt 17 is separated from the four photoconductor drums 11K, 11Y, 11M, and 11C, and the waste toner collecting container 30 is interfering with a later-described contact and separation mechanism. FIG. 6 is a schematic diagram illustrating a state in which the intermediate transfer belt 17 is in contact with the photoconductor drum 11K for forming a monochromatic image. FIG. 7 is a schematic diagram illustrating a state in which the waste toner collecting container 30 is installed in the apparatus body 1 of the image forming apparatus. FIG. 8 is a schematic diagram illustrating a state in which the intermediate transfer belt 17 is in contact with the four photoconductor drums 11K, 11Y, 11M, and 11C. For the sake of simplicity, FIGS. 4, 6, and 8 illustrate a cam 52 as being in contact not with a shaft portion but with a roller portion of the primary transfer bias roller 14K.

As described above, the photoconductor drum 11 serving as an image carrier is removably installed in the apparatus body 1 of the image forming apparatus as one of the components of the process cartridge 15. Specifically, when a not-illustrated main cover of the apparatus body 1 in FIG. 1 is open, each of the process cartridges 15K, 15Y, 15M, and 15C for the respective colors is installed in the apparatus body 1 toward a distal side in a direction perpendicular to the drawing plane, or is removed from the apparatus body 1 toward a proximal side in the direction perpendicular to the drawing plane. The process cartridge 15 is installed in the apparatus body 1 in the direction of arrow B in FIG. 3 along a not-illustrated guide rail provided to the apparatus body 1, to thereby determine the position of the process cartridge 15 in the apparatus body 1.

Further, as described above, in the color image forming operation, the intermediate transfer belt 17 serving as a transfer member comes into contact with the photoconductor drums 11K, 11Y, 11M, and 11C to transfer the toner images carried on the photoconductor drums 11K, 11Y, 11M, and 11C onto the outer circumferential surface of the intermediate transfer belt 17. In the present embodiment, the intermediate transfer belt 17 serving as a transfer member and a plurality of rollers form an intermediate transfer unit, in which the intermediate transfer belt 17 is stretched around and supported by the rollers. The intermediate transfer unit is also removably (i.e., replaceably) configured to be installed in the apparatus body 1 from the same direction as the installation direction of the process cartridge 15.

The image forming apparatus of the present embodiment includes a contact and separation mechanism which moves the intermediate transfer belt 17 relative to the photoconductor drum 11K to cause the intermediate transfer belt 17 to come into contact with or separate from the photoconductor drum 11K.

Specifically, the contact and separation mechanism includes a rotary shaft 53, cams 52, and a lever 51. The rotary shaft 53 extends in the lateral direction in FIGS. 5 and 7, i.e., the direction perpendicular to the drawing plane in FIGS. 1, 4, and 6 (hereinafter referred to as the depth direction). The cams 52 are provided to opposed end portions of the rotary shaft 53 in the depth direction, and come into contact with the shaft portion of the primary transfer bias roller 14K. The lever 51 is provided on the front side of the rotary shaft 53 in the depth direction. When the lever 51 is rotated on the front side in the depth direction, the cams 52 rotate together with the lever 51 around the rotary shaft 53. Accordingly, the primary transfer bias roller 14K vertically moves, causing the intermediate transfer belt 17 to come into contact with or separate from the photoconductor drum 11K.

Specifically, FIGS. 4 and 5 illustrate a state in which the primary transfer bias roller 14K is moved downward by the contact and separation mechanism to separate from the photoconductor drum 11K, and thereby the photoconductor drum 11K for forming a monochromatic image is separated from the intermediate transfer belt 17 as well as the photoconductor drums 11Y, 11M, and 11C for forming a color image. In such a state, the process cartridges 15K, 15Y, 15M, and 15C including the four photoconductor drums 11K, 11Y, 11M, and 11C are partially or fully replaced (i.e., removed and reinstalled) as necessary. This configuration prevents a situation in which the photoconductor drums 11K, 11Y, 11M, and 11C in contact with the intermediate transfer belt 17 are removed from and reinstalled in the apparatus body 1, making the photoconductor drums 11K, 11Y, 11M, and 11C and the intermediate transfer belt 17 rub against each other and damaging the respective surfaces.

Meanwhile, FIGS. 6 and 7 illustrates a state in which the primary transfer bias roller 14K is moved upward by the contact and separation mechanism to come into contact with the photoconductor drum 11K via the intermediate transfer belt 17, and thereby the photoconductor drum 11K for forming a monochromatic image is in contact with the intermediate transfer belt 17. Such a state results from operation of the lever 51 after, for example, the operation of removing and reinstalling the photoconductor drums 11K, 11Y, 11M, and 11C in the separated state illustrated in FIGS. 4 and 5. In this state, the image forming operation in a monochrome mode (i.e., print mode for performing the image forming operation with only the toner of the black color) is performed.

If a full-color mode (i.e., print mode for performing the image forming operation with the toners of the four colors) is selected, the primary transfer bias rollers 14Y, 14M, and 14C for forming a color image are moved upward by a drive control of a not-illustrated second contact and separation mechanism, to bring the intermediate transfer belt 17 into contact with the photoconductor drums 11Y, 11M, and 11C for forming a color image, as illustrated in FIG. 8.

As described above, in the present embodiment, the control of the second contact and separation mechanism is set such that the image forming apparatus in the initial state waiting for a print mode command, such as a post-warm-up state or a standby state, is placed in the monochrome mode, as illustrated in FIGS. 6 and 7. Alternatively, the control of the second contact and separation mechanism may be set such that that the image forming apparatus in the initial state is placed in the full-color mode, as illustrated in FIG. 8. In such a case, the image forming apparatus may be configured such that the four primary transfer bias rollers 14K, 14Y, 14M, and 14C are vertically moved in an interlocking manner by a not-illustrated connecting plate, and that the intermediate transfer belt 17 is brought into contact with or separated from the four photoconductor drums 11K, 11Y, 11M, and 11C in accordance with the operation of rotating the lever 51.

As illustrated in FIGS. 5 and 7, the waste toner collecting container 30 is installed in the image forming apparatus of the present embodiment. The waste toner collecting container 30 is a removable unit in which the untransformed toner discharged by the cleaning blade 15*a* and the intermediate transfer belt cleaning device 19 is collected as waste toner.

The waste toner collecting container 30 serving as a removable unit is removably installed in the apparatus body 1 of the image forming apparatus from the same direction as the installation direction of the process cartridge 15 including the photoconductor drum 11. Further, the waste toner collecting container 30 is disposed proximal of the photoconductor drums 11K, 11Y, 11M, and 11C and the intermediate transfer belt 17 in the installation direction parallel to the depth direction. As illustrated in FIG. 4, for example, the waste toner collecting container 30 is formed to at least partially overlap the photoconductor drums 11K, 11Y, 11M, and 11C and the intermediate transfer belt 17, as viewed in the installation direction parallel to the depth direction. Due to such positional relationship, the process cartridges 15K, 15Y, 15M, and 15C including the photoconductor drums 11K, 11Y, 11M, and 11C and the intermediate transfer belt 17 are prevented from being installed in or removed from the apparatus body 1, unless the waste toner collecting container 30 is removed from the apparatus body 1.

Further, in the present embodiment, when the intermediate transfer belt 17 is separated from the photoconductor drum 11K by the contact and separation mechanism, as illustrated in FIGS. 4 and 5, the waste toner collecting container 30 is dimensioned to interfere with the contact and separation mechanism, and thus is prevented from being installed in the apparatus body 1 of the image forming apparatus. Specifically, when the intermediate transfer belt 17 is separated from the photoconductor drum 11K, the lever 51 is rotated to a position at which the lever 51 interferes with a projection 30*a* of the waste toner collecting container 30. Meanwhile, when the intermediate transfer belt 17 is in contact with the photoconductor drum 11K, the lever 51 is rotated to a position at which the lever 51 does not interfere with the waste toner collecting container 30.

That is, in the separated state as illustrated in FIGS. 4 and 5, if the waste toner collecting container 30 is moved in the direction of arrow C in FIG. 5 to install the waste toner collecting container 30 in the apparatus body 1, the projection 30*a* interferes with the lever 51, preventing the waste toner collecting container 30 from being installed in the apparatus body 1. In this case, the not-illustrated main cover provided on the front side of the apparatus body 1 in the installation direction is prevented from being closed, thereby preventing the image forming apparatus from operating. Accordingly, the image forming operation is not performed in the separated state of the intermediate transfer belt 17. That is, the present configuration prevents the image forming operation from being mistakenly executed in the separated state of the intermediate transfer belt 17 in, for example, replacement work of the process cartridge 15.

Meanwhile, in the contact state as illustrated in FIGS. 6 and 7, the projection 30*a* does not interfere with the lever 51, allowing the waste toner collecting container 30 to be fully installed in the apparatus body 1 in the direction of arrow C in FIG. 7. In this state, therefore, the image forming operation is executed.

In the present embodiment, in accordance with the installation or removal the waste toner collecting container 30 in or from the apparatus body 1, the waste toner collecting container 30 is brought into contact with or separated from the transport tube 15*c* which transports the waste toner, as illustrated in FIGS. 5 and 7. Specifically, a pin 30*c* serving as a pressing member is provided to an upper portion of the waste toner collecting container 30 to rise in the installation direction. Meanwhile, a leading end portion of the transport tube 15*c* is formed with an outlet 15*c*1, and has a shutter member 15*d* provided therein and having a bottom portion formed with an opening to open and close the outlet 15*c*1. In accordance with the installation of the waste toner collecting container 30 into the apparatus body 1, the pin 30*c* serving as a pressing member presses the shutter member 15*d* disposed at the outlet 15*c*1 of the transport tube 15*c*, thereby opening the outlet 15*c*1. That is, the opening of the shutter member 15*d* and the outlet 15*c*1 overlap. At the same time, an inlet 30*b* formed in an upper portion of the waste toner collecting container 30 communicates with the outlet 15*c*1 of the transport tube 15*c*, allowing the waste toner to flow into the waste toner collecting container 30 from the transport tube 15*c*.

As described above, in the present embodiment, the outlet 15*c*1 of the transport tube 15*c* is closed by the shutter member 15*d* in the state in which the waste toner collecting container 30 is not fully installed in the apparatus body 1, as illustrated in FIG. 5. Further, the outlet 15*c*1 of the transport tube 15*c* is opened by the shutter member 15*d* in the state in which the waste toner collecting container 30 is fully installed in the apparatus body 1, as illustrated in FIG. 7. When the waste toner collecting container 30 is not installed in the apparatus body 1, therefore, the waste toner is prevented from leaking from the transport tube 15*c*.

Further, the waste toner collecting container 30 also includes a not-illustrated internal transport member and a gear 30*d*. The transport member transports the waste toner stored in the waste toner collecting container 30. The gear 30*d* is provided to a shaft portion of the transport member to transmit drive force to the transport member. In accordance with the installation of the waste toner collecting container 30 into the apparatus body 1 of the image forming apparatus, the gear 30*d* meshes with a drive gear 62 provided to the apparatus body 1 of the image forming apparatus, as illustrated in FIG. 7. Accordingly, in the present embodiment, the gear 30*d* does not mesh with the drive gear 62 when the waste toner collecting container 30 is not fully installed in the apparatus body 1, as illustrated in FIG. 5. Consequently, erroneous operation of the waste toner collecting container 30 is prevented.

Further, as illustrated in FIGS. 5 and 7, the present embodiment includes an installation sensor 65 serving as a detector that detects the state in which the waste toner collecting container 30 is installed in the apparatus body 1. The image forming apparatus is prevented from operating when the installation sensor 65 serving as a detector detects that the waste toner collecting container 30 is not installed in the apparatus body 1.

Specifically, when the waste toner collecting container 30 is not fully installed in the apparatus body 1, as illustrated in FIG. 5, a movable portion 65*a* of the installation sensor 65 is not in contact with the waste toner collecting container 30, or is in contact with but insufficiently pressed against the waste toner collecting container 30. The image forming apparatus is prevented from performing the image forming operation when this state is detected. Meanwhile, when the waste toner collecting container 30 is fully installed in the apparatus body 1, as illustrated in FIG. 7, the movable portion 65*a* of the installation sensor 65 is in contact with and sufficiently pressed against the waste toner collecting container 30. The image forming apparatus is controlled to perform the image forming operation when this state is detected. With the control using the thus-configured installation sensor 65 serving as a detector, the image forming operation is reliably prevented from being performed in the separated state of the intermediate transfer belt 17.

The present embodiment is configured such that, when the intermediate transfer belt 17 is separated from the photoconductor drum 11K by the contact and separation mechanism, as illustrated in FIGS. 4 and 5, the waste toner collecting container 30 deliberately interferes with the contact and separation mechanism, and is prevented from being installed in the apparatus body 1.

Figure 9A:
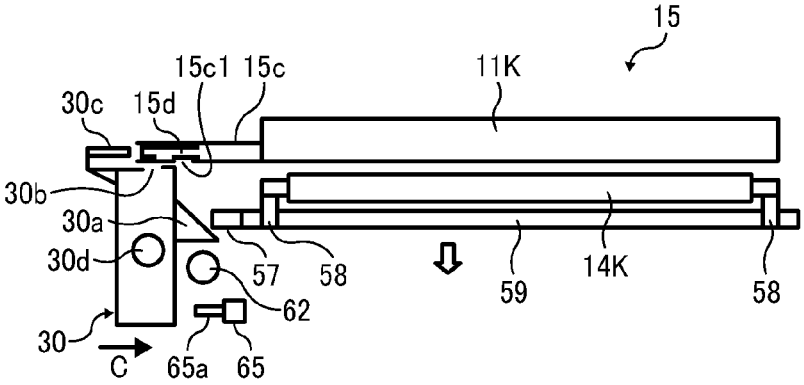
FIGS. 9A and 9B are schematic diagrams of a second embodiment of the present invention, illustrating a process of installing the waste toner collecting container in the image forming apparatus.
Figure 9B:
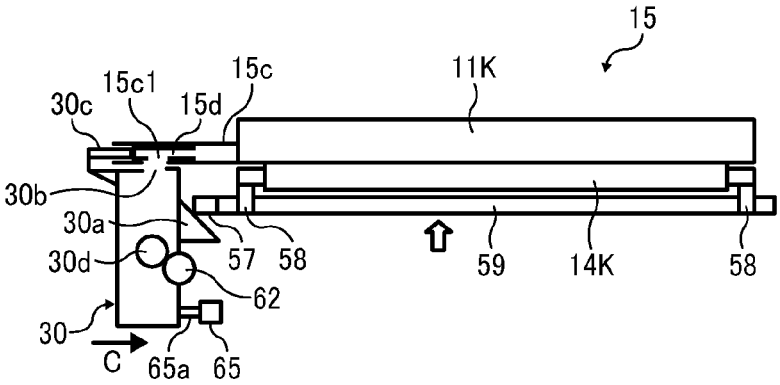

Alternatively, as illustrated in FIGS. 9A and 9B, the contact and separation mechanism may be configured to raise the primary transfer bias roller 14K and thereby bring the intermediate transfer belt 17 into contact with the photoconductor drum 11K in accordance with the installation of the waste toner collecting container 30 into the apparatus body 1 of the image forming apparatus, and to lower the primary transfer bias roller 14K and thereby separate the intermediate transfer belt 17 from the photoconductor drum 11K in accordance with the removal of the waste toner collecting container 30 from the apparatus body 1 of the image forming apparatus.

Specifically, the image forming apparatus illustrated in FIGS. 9A and 9B includes a contact and separation mechanism including a shaft 59, not-illustrated guide grooves, holders 58, and a contact member 57. The shaft 59 extends in the depth direction. The guide grooves guide vertical movement of the shaft 59. The holders 58 are provided to opposed end portions of the shaft 59 in the depth direction to hold the shaft portion of the primary transfer bias roller 14K. The contact member 57 is formed on the front side of the shaft 59 in the depth direction. As illustrated in FIG. 9A, if the waste toner collecting container 30 is moved in the direction of arrow C to install the waste toner collecting container 30 in the apparatus body 1, the projection 30*a* of the waste toner collecting container 30 having an inclined upper surface comes into contact with the contact member 57. If the waste toner collecting container 30 is further moved in the direction of arrow C to install the waste toner collecting container 30 in the apparatus body 1, the contact member 57 is moved upward by the projection 30*a*, and the entire contact and separation mechanism is moved upward, as illustrated in FIG. 9B. Thereby, the primary transfer bias roller 14K also moves upward, bringing the intermediate transfer belt 17 into contact with the photoconductor drum 11K.

Meanwhile, if the waste toner collecting container 30 is removed from the apparatus body 1, the contact between the contact member 57 and the projection 30*a* is cancelled. Thereby, the primary transfer bias roller 14K is moved downward by the weight thereof, and the intermediate transfer belt 17 separates from the photoconductor drum 11K. In the thus-configured embodiment, therefore, the image forming apparatus is prevented from operating when the intermediate transfer belt 17 is separated from the photoconductor drum 11K, similarly as in the foregoing embodiment.

As described above, the embodiments of the present invention are configured such that the removable waste toner collecting container 30 (i.e., a removable unit) is disposed proximal of the photoconductor drums 11K, 11Y, 11M, and 11C (i.e., image carriers) in the installation direction, and that the waste toner collecting container 30 is prevented from being correctly installed in the apparatus body 1 of the image forming apparatus unless the intermediate transfer belt 17 (i.e., a transfer member) is kept in correct contact with the photoconductor drum 11K by the contact and separation mechanism. In the configuration, the intermediate transfer belt 17 is contactable with and separable from the photoconductor drum 11K. Therefore, the image forming apparatus is reliably prevented from operating when the intermediate transfer belt 17 is separated from the photoconductor drum 11K.

In the above-described embodiments, the photoconductor drum 11, the charging roller 12, the cleaning blade 15*a* (i.e., a cleaning device), and the lubricant supply device 16 in the image forming unit are integrated to form the process cartridge 15 so as to make the image forming unit compact and facilitate maintenance. Alternatively, the development device 13 may also be included in the process cartridge 15 as a component thereof. Further, the photoconductor drum 11 may be configured not as a component of the process cartridge 15 but as a separate member independently installable in and removable from the apparatus body 1. In this case, it is preferable to configure the development roller 13*a* and the charging roller 12 to be separated from the photoconductor drum 11. Also in this case, similar effects to those of the above-described embodiments are obtainable.

Further, in the above-described embodiments, the present invention is applied to the image forming apparatus including the development device 13 which employs the one-component development system using the one-component developer. The present invention, however, is also applicable to an image forming apparatus including the development device 13 which employs a two-component development system using a two-component developer.

Further, in the above-described embodiments, the present invention is applied to the tandem-type color image forming apparatus including the intermediate transfer belt 17. The present invention, however, is also applicable to different types of image forming apparatuses, such as a tandem-type color image forming apparatus including a transfer feed belt, in which toner images on a plurality of photoconductor drums juxtaposed to face the transfer feed belt are superimposed and transferred onto a recording medium fed by the transfer feed belt, and a monochrome image forming apparatus including a transfer belt. In this case, the transfer feed belt or the transfer belt functions as a transfer member which transfers a toner image carried on an image carrier onto a recording medium fed to a position between the belt and the image carrier, and a contact and separation mechanism is provided which causes the transfer member to come into contact with or separate from the image carrier. Also in this case, similar effects to those of the above-described embodiments are obtainable.

Further, in the above-described embodiments, the waste toner collecting container 30 is used as a removable unit configured not to be correctly installed in the apparatus body 1 in the separated state of the intermediate transfer belt 17. Alternatively, a unit other than the waste toner collecting container 30, such as a large-capacity toner container, for example, may be used as the removable unit. Also in this case, similar effects to those of the above-described embodiments are obtainable.

Further, in the present application, the term "process cartridge" is defined as a unit which integrates an image carrier and at least one of a charging device that charges the image carrier, a development device that develops a latent image formed on the image carrier, and a cleaning device that cleans a surface of the image carrier, and which is removably installed in the body of an image forming apparatus.

The above-described embodiments and effects thereof are illustrative and do not limit the present invention. Thus, numerous additional modifications and variations are possible in light of the above teachings. For example, elements or features of different illustrative and embodiments herein may be combined with or substituted for each other within the scope of this disclosure and the appended claims. Further, features of components of the embodiments, such as number, position, and shape, are not limited to those of the disclosed embodiments and thus may be set as preferred. It is therefore to be understood that, within the scope of the appended claims, the disclosure of the present invention may be practiced otherwise than as specifically described herein.

What is claimed is:

1. An image forming apparatus comprising:

an image carrier configured to be removably installed in the image forming apparatus to carry a toner image;

a transfer member configured to come into contact with the image carrier to transfer the toner image from the image carrier onto a surface of the transfer member, the transfer member being a transfer belt;

a contact and separation mechanism configured to move the transfer member relative to the image carrier to bring the transfer member into contact with the image carrier, and configured to move the transfer member relative to the image carrier to separate the transfer member from the image carrier; and a removable unit configured to be removably installed in the image forming apparatus to be disposed proximal of the image carrier and the transfer member, and configured to at least partially overlap the image carrier and the transfer member as viewed in an installation direction of the image carrier, the removable unit interfering with the contact and separation mechanism and prevented from being installed in the image forming apparatus in a state in which the transfer member is separated from the image carrier by the contact and separation mechanism.

2. The image forming apparatus according to claim 1, wherein the contact and separation mechanism comprises a lever configured to be rotated to bring the transfer member into contact with the image carrier, and configured to be rotated to separate the transfer member from the image carrier, wherein, when the transfer member is separated from the image carrier, the lever is rotated to a position at which the lever interferes with the removable unit, and wherein, when the transfer member is in contact with the image carrier, the lever is rotated to a position at which the lever does not interfere with the removable unit.

3. The image forming apparatus according to claim 1, further comprising:

a detector configured to detect a state in which the removable unit is installed in the image forming apparatus, wherein the image forming apparatus is prevented from operating when the detector detects that removable unit is not installed in the image forming apparatus.

4. The image forming apparatus according to claim 1, further comprising:

a cleaning device configured to remove untransferred toner remaining on the image carrier as waste toner; and a transport tube configured to transport the waste toner discharged by the cleaning device, wherein the removable unit includes a waste toner collecting container configured to store the waste toner, the waste toner collecting container brought into contact with the transport tube when installed in the image forming apparatus, and separated from the transport tube when removed from the image forming apparatus.

5. The image forming apparatus according to claim 4, further comprising a drive gear configured to transmit drive force, wherein the transport tube includes:

an outlet configured to discharge the waste toner; and a shutter member configured to open and close the outlet, and wherein the waste toner collecting container includes:

a pressing member configured to press the shutter member of the transport tube and open the outlet in accordance with the installation of the waste toner collecting container into the image forming apparatus;

a transport member configured to transport the waste toner stored in the waste toner collecting container; and a gear configured to mesh with the drive gear in accordance with the installation of the waste toner collecting container into the image forming apparatus to transmit the drive force to the transport member.

6. An image forming apparatus comprising:

an image carrier configured to be removably installed in the image forming apparatus to carry a toner image;

a transfer member configured to come into contact with the image carrier to transfer the toner image from the image carrier onto a surface of the transfer member, the transfer member being a transfer belt;

a contact and separation mechanism configured to move the transfer member relative to the image carrier to bring the transfer member into contact with the image carrier, and configured to move the transfer member relative to the image carrier to separate the transfer member from the image carrier; and a removable unit configured to be removably installed in the image forming apparatus to be disposed proximal of the image carrier and the transfer member, and configured to at least partially overlap the image carrier and the transfer member as viewed in an installation direction of the image carrier, the contact and separation mechanism bringing the transfer member into contact with the image carrier in accordance with installation of the removable unit into the image forming apparatus, and separating the transfer member from the image carrier in accordance with removal of the removable unit from the image forming apparatus.

7. The image forming apparatus according to claim 6, further comprising:

a detector configured to detect a state in which the removable unit is installed in the image forming apparatus, wherein the image forming apparatus is prevented from operating when the detector detects that the removable unit is not installed in the image forming apparatus.

8. The image forming apparatus according to claim 6, further comprising:

a cleaning device configured to remove untransferred toner remaining on the image carrier as waste toner; and a transport tube configured to transport the waste toner discharged by the cleaning device, wherein the removable unit includes a waste toner collecting container configured to store the waste toner, the waste toner collecting container brought into contact with the transport tube when installed in the image forming apparatus, and separated from the transport tube when removed from the image forming apparatus.

9. The image forming apparatus according to claim 8, further comprising a drive gear configured to transmit drive force, wherein the transport tube includes:

an outlet configured to discharge the waste toner; and a shutter member configured to open and close the outlet, and wherein the waste toner collecting container includes:

a pressing member configured to press the shutter member of the transport tube and open the outlet in accordance with the installation of the waste toner collecting container into the image forming apparatus;

a transport member configured to transport the waste toner stored in the waste toner collecting container; and a gear configured to mesh with the drive gear in accordance with the installation of the waste toner collecting container into the image forming apparatus to transmit the drive force to the transport member.

10. The image forming apparatus of claim 1 further comprising:

a first transfer roller configured to transfer the toner image from the image carrier to the surface of the transfer member when the transfer member contacts the image carrier, the contact and separation mechanism being configured to cause the first transfer roller to move the first transfer member from a first position where the first transfer member does not contact the image carrier to a second position where the first transfer member does contact the image carrier, the contact and separation mechanism being configured to cause the first transfer roller to move the first transfer member from the second position to the first position, the removable unit being configured to interfere with the contact and separation mechanism such that the removable unit is prevented from being installed when the first transfer member is in the first position.

11. The image forming apparatus of claim 1, wherein the removable unit is configured to be removably installed in the image forming apparatus from the same direction as the installation direction of the image carrier to be disposed proximal of the image carrier and the transfer member in the installation direction.

12. The image forming apparatus of claim 6 further comprising:

a first transfer roller configured to transfer the toner image from the image carrier to the surface of the transfer member when the transfer member contacts the image carrier, the contact and separation mechanism being configured to cause the first transfer roller to move the first transfer member from a first position where the first transfer member does not contact the image carrier to a second position where the first transfer member does contact the image carrier, the contact and separation mechanism being configured to cause the first transfer roller to move the first transfer member from the second position to the first position, the removable unit being configured to interfere with the contact and separation mechanism such that the removable unit is prevented from being installed when the first transfer member is in the first position.

13. The image forming apparatus of claim 6, wherein the removable unit is configured to be removably installed in the image forming apparatus from the same direction as the installation direction of the image carrier to be disposed proximal of the image carrier and the transfer member in the installation direction.

* * * * *